US010145211B2

(12) United States Patent
Santoso et al.

(10) Patent No.: US 10,145,211 B2
(45) Date of Patent: Dec. 4, 2018

(54) POWER AND COMMUNICATIONS ADAPTER

(71) Applicant: Schlumberger Technology Corporation, Sugar Land, TX (US)

(72) Inventors: David Santoso, Sugar Land, TX (US); Randall LeBlanc, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 23 days.

(21) Appl. No.: 14/850,036

(22) Filed: Sep. 10, 2015

(65) Prior Publication Data

US 2017/0074073 A1 Mar. 16, 2017

(51) Int. Cl.

| | |
|---|---|
| ***G01C 3/00*** | (2006.01) |
| ***E21B 41/00*** | (2006.01) |
| ***E21B 47/12*** | (2012.01) |

(52) U.S. Cl.
CPC ..... *E21B 41/00* (2013.01); *E21B 41/0085* (2013.01); *E21B 47/12* (2013.01)

(58) Field of Classification Search
CPC ..... E21B 41/00; E21B 47/12
See application file for complete search history.

(56) References Cited

U.S. PATENT DOCUMENTS

2002/0043369 A1 4/2002 Vinegar et al.
2002/0113718 A1* 8/2002 Wei ..... E21B 47/12 340/855.3
2003/0213620 A1 11/2003 Krueger
2010/0224356 A1 9/2010 Moore
2010/0264747 A1* 10/2010 Hall ..... B60L 11/182 307/104
2014/0202711 A1 7/2014 Scott et al.
2014/0311804 A1* 10/2014 Gadot ..... E21B 47/00 175/57

FOREIGN PATENT DOCUMENTS

WO WO9716751 A1 5/1997

OTHER PUBLICATIONS

International Search Report and Written Opinion issued in International Patent application PCT/US2016/049548 dated Dec. 21, 2016, 13 pages.
International Preliminary Report on Patentability issued in International Patent application PCT/US2016/049548, dated Mar. 13, 2018, 9 pages.

* cited by examiner

*Primary Examiner* — Adolf Dsouza

(57) ABSTRACT

Aspects of the disclosure can relate to an adapter for power and communication connections between electronic devices in a drill string. In embodiments, the adapter can include a first terminal configured to couple with an output terminal of a first tool and a second terminal configured to couple with an input terminal of a second tool. The adapter can further include a power converter that adjusts a voltage received at the first terminal and supplies the adjusted voltage to the second terminal and a communications adapter that converts a signal format of a communications signal received at the first terminal to a second signal format for the second terminal.

22 Claims, 8 Drawing Sheets

POWER AND COMMUNICATIONS ADAPTER

BACKGROUND

Oil wells are created by drilling a hole into the earth using a drilling rig that rotates a drill string (e.g., drill pipe) having a drill bit attached thereto. The drill bit, aided by the weight of pipes (e.g., drill collars) cuts into rock within the earth. Drilling fluid (e.g., mud) is pumped into the drill pipe and exits at the drill bit. The drilling fluid may be used to cool the bit, lift rock cuttings to the surface, at least partially prevent destabilization of the rock in the wellbore, and/or at least partially overcome the pressure of fluids inside the rock so that the fluids do not enter the wellbore. Other equipment can also be used for evaluating formations, fluids, production, other operations, and so forth.

SUMMARY

Aspects of the disclosure can relate to an adapter for power and communication connections between electronic devices in a drill string. In embodiments, the adapter can include a first terminal configured to couple with an output terminal of a first tool and a second terminal configured to couple with an input terminal of a second tool. The adapter can further include a power converter that adjusts a voltage received at the first terminal and supplies the adjusted voltage to the second terminal and a communications adapter that converts a signal format of a communications signal received at the first terminal to a second signal format for the second terminal.

This summary is provided to introduce a selection of concepts that are further described below in the detailed description. This summary is not intended to identify key or essential features of the claimed subject matter, nor is it intended to be used as an aid in limiting the scope of the claimed subject matter.

FIGURES

Embodiments of systems and methods that can implement a power and communications adapter are described with reference to the following figures. The same numbers are used throughout the figures to reference like features and components.

DETAILED DESCRIPTION

Figure 1:
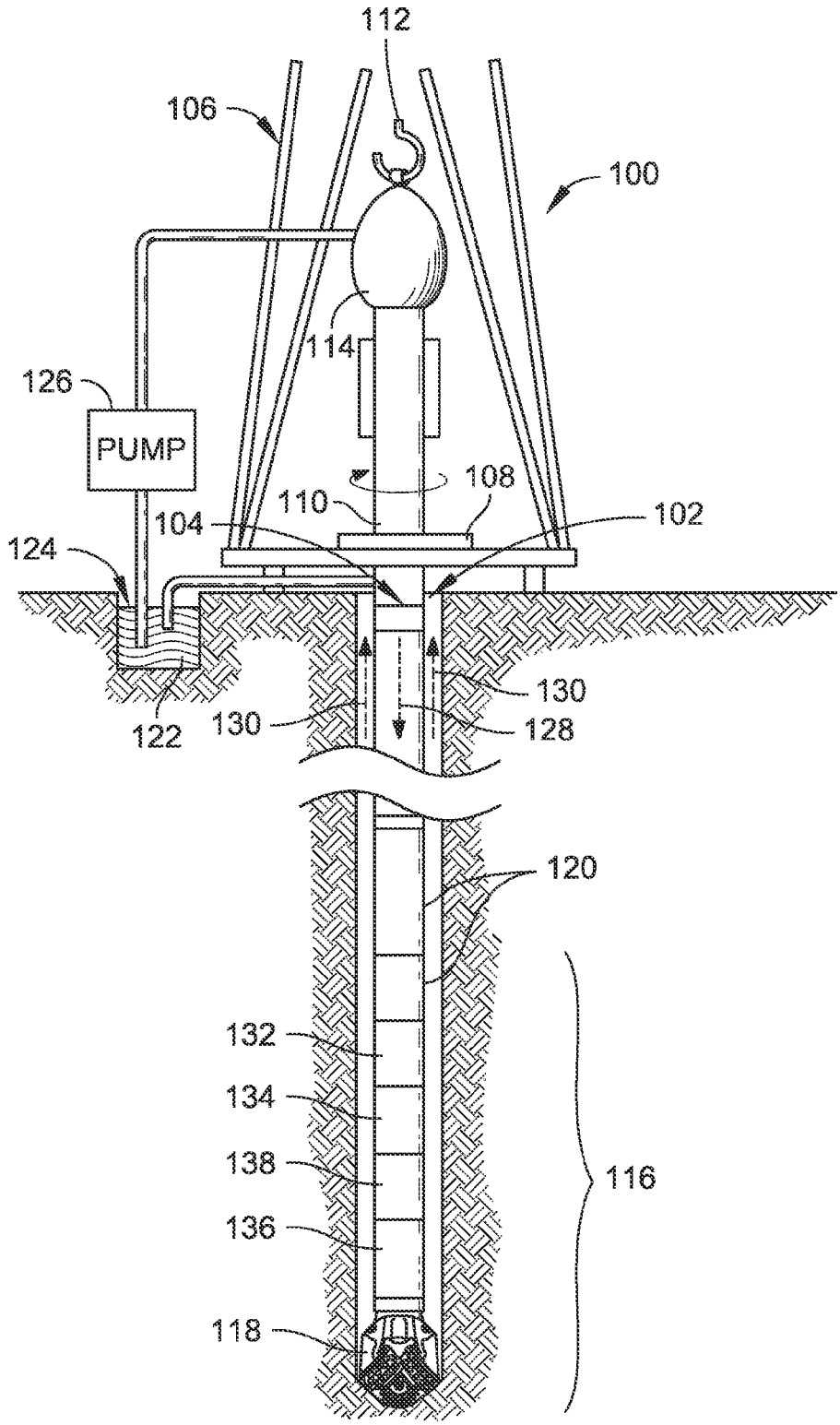
FIG. 1 illustrates an example system in which embodiments of a power and communications adapter can be implemented.

FIG. 1 depicts a wellsite system 100 in accordance with one or more embodiments of the present disclosure. The wellsite can be onshore or offshore. A borehole 102 is formed in subsurface formations by directional drilling. A drill string 104 extends from a drill rig 106 and is suspended within the borehole 102. In some embodiments, the wellsite system 100 implements directional drilling using a rotary steerable system (RSS). For instance, the drill string 104 is rotated from the surface, and down-hole devices move the end of the drill string 104 in a desired direction. The drill rig 106 includes a platform and derrick assembly positioned over the borehole 102. In some embodiments, the drill rig 106 includes a rotary table 108, kelly 110, hook 112, rotary swivel 114, and so forth. For example, the drill string 104 is rotated by the rotary table 108, which engages the kelly 110 at the upper end of the drill string 104. The drill string 104 is suspended from the hook 112 using the rotary swivel 114, which permits rotation of the drill string 104 relative to the hook 112. However, this configuration is provided by way of example and is not meant to limit the present disclosure. For instance, in other embodiments a top drive system is used.

A bottom hole assembly (BHA) 116 is suspended at the end of the drill string 104. The bottom hole assembly 116 includes a drill bit 118 at its lower end. In embodiments of the disclosure, the drill string 104 includes a number of drill pipes 120 that extend the bottom hole assembly 116 and the drill bit 118 into subterranean formations. Drilling fluid (e.g., mud) 122 is stored in a tank and/or a pit 124 formed at the wellsite. The drilling fluid can be water-based, oil-based, and so on. A pump 126 displaces the drilling fluid 122 to an interior passage of the drill string 104 via, for example, a port in the rotary swivel 114, causing the drilling fluid 122 to flow downwardly through the drill string 104 as indicated by directional arrow 128. The drilling fluid 122 exits the drill string 104 via ports (e.g., courses, nozzles) in the drill bit 118, and then circulates upwardly through the annulus region between the outside of the drill string 104 and the wall of the borehole 102, as indicated by directional arrows 130. In this manner, the drilling fluid 122 cools and lubricates the drill bit 118 and carries drill cuttings generated by the drill bit 118 up to the surface (e.g., as the drilling fluid 122 is returned to the pit 124 for recirculation).

In some embodiments, the bottom hole assembly 116 includes down-hole tools, such as a logging-while-drilling (LWD) module 132, a measuring-while-drilling (MWD) module 134, a rotary steerable system 136, a motor, and so forth (e.g., in addition to the drill bit 118). The logging-while-drilling module 132 can be housed in a drill collar and can contain one or a number of logging tools. It should also be noted that more than one LWD module and/or MWD module can be employed (e.g., as represented by another logging-while-drilling module 138). In embodiments of the disclosure, the logging-while drilling modules 132 and/or 138 include capabilities for measuring, processing, and storing information, as well as for communicating with surface equipment, and so forth.

The measuring-while-drilling module 134 can also be housed in a drill collar, and can contain one or more devices for measuring characteristics of the drill string 104 and drill bit 118. The measuring-while-drilling module 134 can also include components for generating electrical power for down-hole tools (e.g., sensors, electrical motors, transmitters, receivers, controllers, energy storage devices, and so forth). For example, the system can include a mud turbine generator (also referred to as a "mud motor") powered by the flow of the drilling fluid 122. However, this configuration is provided by way of example and is not meant to limit the present disclosure. In other embodiments, other power and/or battery systems can be employed. The measuring-while-drilling module 134 can include one or more of the following measuring devices: a weight-on-bit measuring device, a torque measuring device, a vibration measuring device, a shock measuring device, a stick slip measuring device, a direction measuring device, an inclination measuring device, and so on.

In embodiments of the disclosure, the wellsite system 100 is used with controlled steering or directional drilling. For example, the rotary steerable system 136 is used for directional drilling. As used herein, the term "directional drilling" describes intentional deviation of the wellbore from the path it would naturally take. Thus, directional drilling refers to steering the drill string 104 so that it travels in a desired direction. In some embodiments, directional drilling is used for offshore drilling (e.g., where multiple wells are drilled from a single platform). In other embodiments, directional drilling enables horizontal drilling through a reservoir, which enables a longer length of the wellbore to traverse the reservoir, increasing the production rate from the well. Further, directional drilling may be used in vertical drilling operations. For example, the drill bit 118 may veer off of a planned drilling trajectory because of the unpredictable nature of the formations being penetrated or the varying forces that the drill bit 118 experiences. When such deviation occurs, the wellsite system 100 may be used to guide the drill bit 118 back on course.

Drill assemblies can be used with, for example, a wellsite system (e.g., the wellsite system 100 described with reference to FIG. 1). For instance, a drill assembly can comprise a bottom hole assembly suspended at the end of a drill string (e.g., in the manner of the bottom hole assembly 116 suspended from the drill string 104 depicted in FIG. 1). In some embodiments, a drill assembly is implemented using a drill bit. However, this configuration is provided by way of example and is not meant to limit the present disclosure. In other embodiments, different working implement configurations are used. Further, use of drill assemblies in accordance with the present disclosure is not limited to wellsite systems described herein. Drill assemblies can be used in other various cutting and/or crushing applications, including earth boring applications employing rock scraping, crushing, cutting, and so forth.

A drill assembly includes a body for receiving a flow of drilling fluid. The body comprises one or more crushing and/or cutting implements, such as conical cutters and/or bit cones having spiked teeth (e.g., in the manner of a roller-cone bit). In this configuration, as the drill string is rotated, the bit cones roll along the bottom of the borehole in a circular motion. As they roll, new teeth come in contact with the bottom of the borehole, crushing the rock immediately below and around the bit tooth. As the cone continues to roll, the tooth then lifts off the bottom of the hole and a high-velocity drilling fluid jet strikes the crushed rock chips to remove them from the bottom of the borehole and up the annulus. As this occurs, another tooth makes contact with the bottom of the borehole and creates new rock chips. In this manner, the process of chipping the rock and removing the small rock chips with the fluid jets is continuous. The teeth intermesh on the cones, which helps clean the cones and enables larger teeth to be used. A drill assembly comprising a conical cutter can be implemented as a steel milled-tooth bit, a carbide insert bit, and so forth. However, roller-cone bits are provided by way of example and are not meant to limit the present disclosure. In other embodiments, a drill assembly is arranged differently. For example, the body of the bit comprises one or more polycrystalline diamond compact (PDC) cutters that shear rock with a continuous scraping motion.

In embodiments of the disclosure, the body of a drill assembly can define one or more nozzles that allow the drilling fluid to exit the body (e.g., proximate to the crushing and/or cutting implements). The nozzles allow drilling fluid pumped through, for example, a drill string to exit the body. For example, drilling fluid can be furnished to an interior passage of the drill string by the pump and flow downwardly through the drill string to a drill bit of the bottom hole assembly, which can be implemented using, for example, a drill assembly. Drilling fluid then exits the drill string via nozzles in the drill bit, and circulates upwardly through the annulus region between the outside of the drill string and the wall of the borehole. In this manner, rock cuttings can be lifted to the surface, destabilization of rock in the wellbore can be at least partially prevented, the pressure of fluids inside the rock can be at least partially overcome so that the fluids do not enter the wellbore, and so forth.

In some drilling systems, power and communication signals are carried over the same single conductor (e.g., single wire). For example, a signal transmitted from one electronic device or tool (e.g., MWD 134, LWD 132/138, sensor, electrical motor, transmitter, receiver, controller, energy storage device, and or the like) to a second electronic device or tool can include power and communication components transferred over a single conductor. Other drilling systems can use multiple-wire connections and/or different communication protocols to send power and communication signals from one tool to another along a drill string. In some of these systems, at least two separate conductors (e.g., two or more wires) can include at least a first wire that carries a power signal and at least a second wire that carries a communication signal. Other operating differences can also be encountered between different system architectures. For example, some legacy systems rely on power signals with voltage of approximately 30V and a passband communication signal; while newer systems can have power signals transmitting at approximately 300V with baseband communication protocols.

Figure 2A:
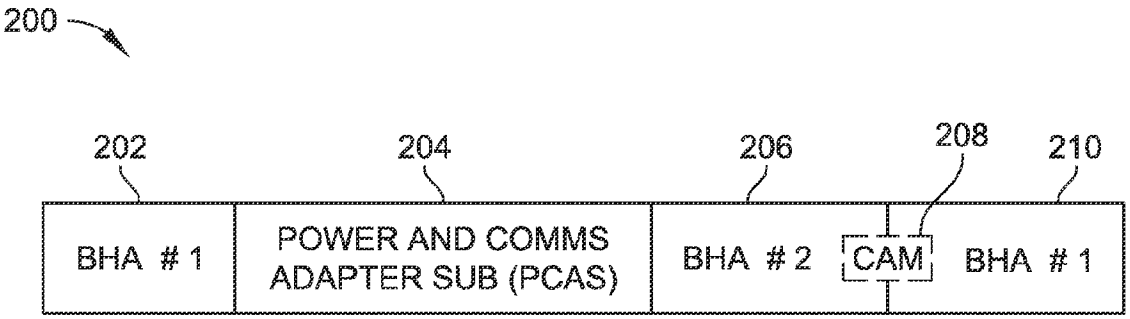
FIG. 2A illustrates an example of a tool string in which embodiments of a power and communications adapter can be implemented.
Figure 2B:
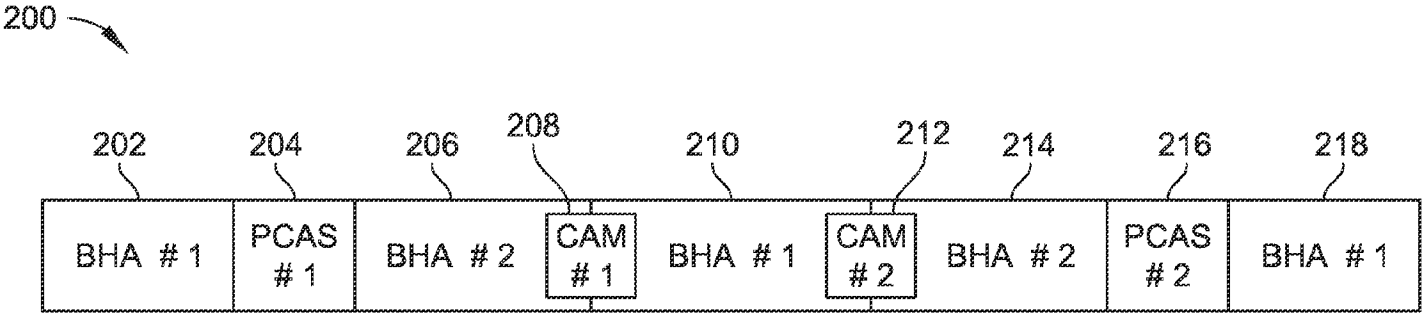
FIG. 2B illustrates an example of a tool string in which embodiments of a power and communications adapter can be implemented.

FIGS. 2A through 8 illustrate systems that can implement adapters that couple a tool or BHA 116 utilizing one system architecture (e.g., with multi-conductor connectivity) to another tool or BHA 116 having another system architecture (e.g., with single-conductor connectivity). This can improve system capabilities by enabling legacy tools and new tools to be coupled with one another in the same drill string. FIGS. 2A and 2B show embodiments of a tool string 200 (e.g., one or more connected BHAs 116 or tools suspended from a drill string 104). A power and communications adapter sub (PCAS) 204 can couple two BHAs (e.g., BHA 202 and BHA 206) or tools and can convert both power voltage level and communication method between tools on either side of the PCAS 204. In some embodiments, a communications adapter module (CAM) 208 can couple two BHAs (e.g., BHA 206 and BHA 210). The CAM can convert a communication method between tools on either side of the CAM 208, while leaving the power voltage level unchanged. The communication method can include the protocol, modulation, bus topology, and/or signal power levels. For example, the PCAS 204 or CAM 208 can convert from 4.8kbps LTB (Low Power Tool Bus) with Frequency Shift Keying (FSK) modulation to 150kbps HSB (High Speed Bus) with Quadrature Phase Shift Keying (QPSK) modulation. Multiple PCASs and CAMs can be placed to link several BHAs as shown in FIG. 2B. For example, the tool string 200 can further include a second CAM 212 linking another set of BHAs (e.g., BHA 210 and BHA 214) or tools and/or a second PCAS 216 linking another set of BHAs (e.g., BHA 214 and 218) or tools, and so forth.

Figure 3:
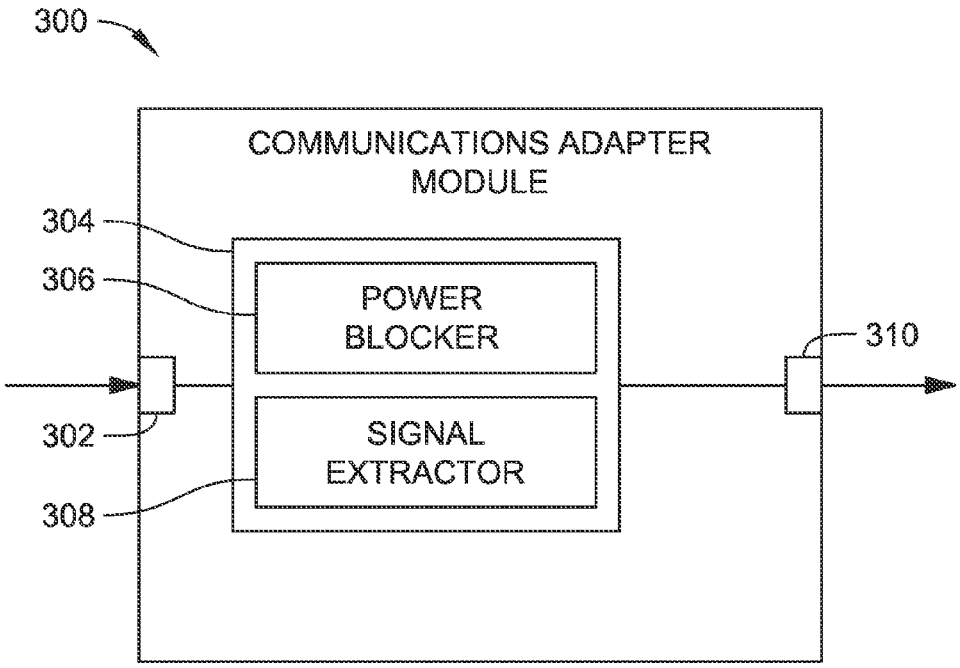
FIG. 3 illustrates an embodiment of a communications adapter module that can be implemented in a system including a tool string, such as the system illustrated in FIG. 1, 2A, or 2B.

In some embodiments, the CAM 208 can be attached to extenders that link the two BHAs or tools. The CAM 208 can electrically terminate the bus to maintain signal integrity and avoid current reflections on the linked BHAs or tools. Dual MWD Isolation Adapter (DMIA) components can be included in the CAM 208, so that the CAM 208 can isolate the power between the two adjacent BHAs or tools. For example, such isolation adapter configurations are described in U.S. Patent Application Publication No. 2014/0311804 to Gadot et al., which is incorporated herein by reference in its entirety. FIG. 3 shows an embodiment of a CAM 300 (such as CAM 208 in the tool string 200). The CAM 300 includes at least one input terminal 302 configured to couple to an output terminal of a first tool, which can be part of a first BHA, and at least one output terminal 310 configured to couple to an input terminal of a second tool, which can be part of a second BHA. CAM circuitry 304 can include a signal extractor 308 that isolates a communication component (e.g., data or information component) of a signal received at the input terminal 302 and transmits the communication component of the signal through the output terminal 310. In some embodiments, the signal extractor 308 also includes a communications converter or adapter that converts the communication method of the signal from a first format received at the input terminal 302 to a second (different) format that is appropriate for the tool or BHA coupled to the output terminal 310. The CAM circuitry 304 can also include a power blocker 306 that substantially blocks or terminates a power component (e.g., DC component) of the signal.

Figure 4:
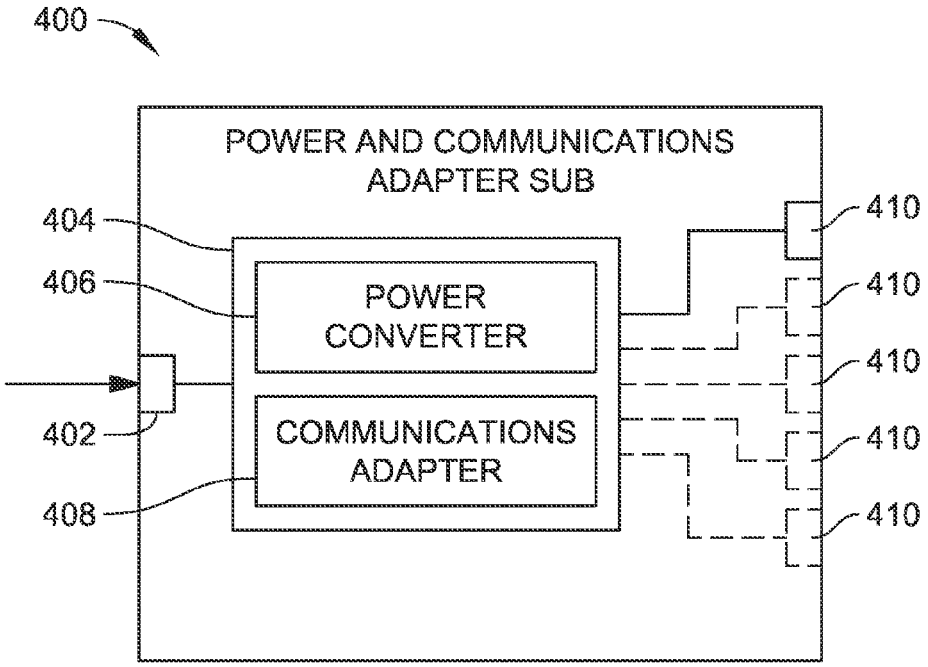
FIG. 4 illustrates an embodiment of a power and communications adapter that can be implemented in a system including a tool string, such as the system illustrated in FIG. 1, 2A, or 2B.

In embodiments, the PCAS 204 can be combined with or coupled to the MWD tool to generate power for two adjacent BHAs (e.g., BHA 202 and BHA 206) at different voltage levels. The PCAS 204 can also be the bus master for both BHAs, each using different communication methods. FIG. 4 shows an embodiment of a PCAS 400 (such as PCAS 204 in the tool string 200). The PCAS 400 includes at least one input terminal 402 configured to couple to an output terminal of a first tool, which can be part of a first BHA, and at least one output terminal 410 configured to couple to an input terminal of a second tool, which can be part of a second BHA. In some embodiments, the input terminal 402 can be embedded within the first BHA or an extender coupled to the first BHA, and the output terminal 410 can be embedded within or coupled to the second BHA or an extender coupled to the second BHA.

PCAS circuitry 404 can include a power converter 406 (e.g., an AC-to-DC converter, a transformer for AC-to-AC power conversion, linear/switching converter for DC-to-DC power conversion, or the like) that adjusts a voltage received at the input terminal 402 and supplies the adjusted voltage to the output terminal 410. For example, the power converter 406 can step an input voltage in the range of 10V to 100V up to an output voltage in the range of 200V to 1000V. PCAS circuitry 404 can also include a communications adapter 408 that converts a communication method (e.g., signal format or signal protocol) of a communications signal received at the input terminal 402 to a second signal format for the output terminal 410. For example, the input terminal 402 can receive a passband communication protocol that is converted by the communications adapter 408 to a baseband communication protocol for the output terminal 410, or vice versa. The communications adapter 408 can also convert from passband communication with a first signal power level or signal format to passband communication with a second signal power level or signal format. The communications adapter 408 can also implement baseband-to-baseband conversions or any other signal conversion where one or more components of the communication method (e.g., signal type, format, communication protocol, power level, etc.) are altered. In some embodiments, the input terminal 402 comprises a single-wire input terminal 402, and the output terminal 410 comprises a multiple-wire output terminal 410 having multiple ports (e.g., as shown in FIG. 4). The communications adapter can convert a combined communications and power signal received by the single-wire input terminal 402 into at least one power signal and at least one communications signal for respective ports of the multiple-wire output terminal 410. It is noted that the configuration shown in FIG. 4 can be reversed, such that the input terminal 402 comprises a multiple-wire input terminal having multiple ports, and the output terminal 410 comprises a single-wire output terminal. In some embodiments, the input terminal 402 is also structured to receive a different connector type from the output terminal 410.

Figure 5:
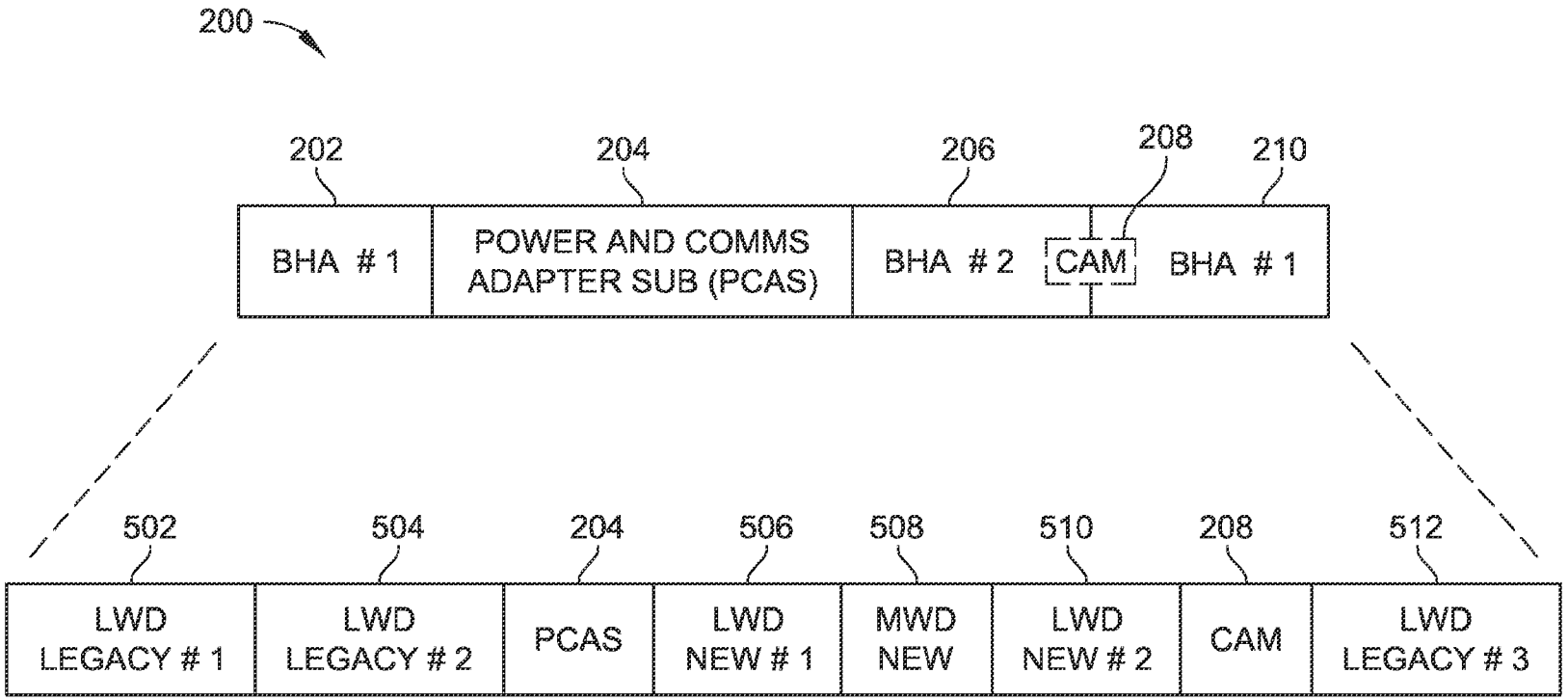
FIG. 5 illustrates an example of a tool string in which embodiments of a power and communications adapter can be implemented.

Examples of interconnectivity between tools of a first BHA (e.g., BHA 202) and a second BHA (e.g., BHA 206) are shown in FIG. 5. For example, a first set of BHA tools (e.g., legacy LWD tools 502, 504, and 512) can be connected with a second set of BHA tools (e.g., new MWD tool 508 and LWD tools 506 and 510) with the PCAS 204 in the tool string to connect legacy LWD 504 with new LWD 506 and/or the CAM 208 to connect new LWD 510 and legacy LWD 512. The CAM 208 can be used where the first BHA tools and the second BHA tools are capable of being independently powered (e.g., by respective MWDs). In an example configuration (e.g., as shown in FIG. 5), the first and second legacy LWDs 502 and 504 use legacy power and communication bus; the PCAS 204 converts new power and communication bus protocols to legacy power and communication protocols to allow the new MWD 508 to operate as the bus master and power generator or distributor. The CAM 208 converts the new communication protocol to legacy communication protocol to facilitate communication between new LWD 510 and legacy LWD 512; and CAM 208 further isolates power between new LWD 510 and legacy LWD 512 to allow both LWDs to be independently powered. For example, LWD 510 is powered by MWD 508 and LWD 512 is battery powered or powered by a different source (e.g., a legacy MWD).

In some embodiments, the first tool is part of a first BHA (e.g., BHA 202) having a single conductor carrying both power and communication (e.g., tool bus) signals, with 30V DC power and Low Power Tool Bus (LTB) having 4.8 kbps Frequency-Shift Keying (FSK) modulation communication signals, and the second tool is part of a second BHA (e.g., BHA 206) having multiple conductors (e.g., separate wires for power and communications), with 650V DC power and enhanced fast tool bus (EFTB) having 2 Mbps bi-phase modulation communication signals.

Figure 6:
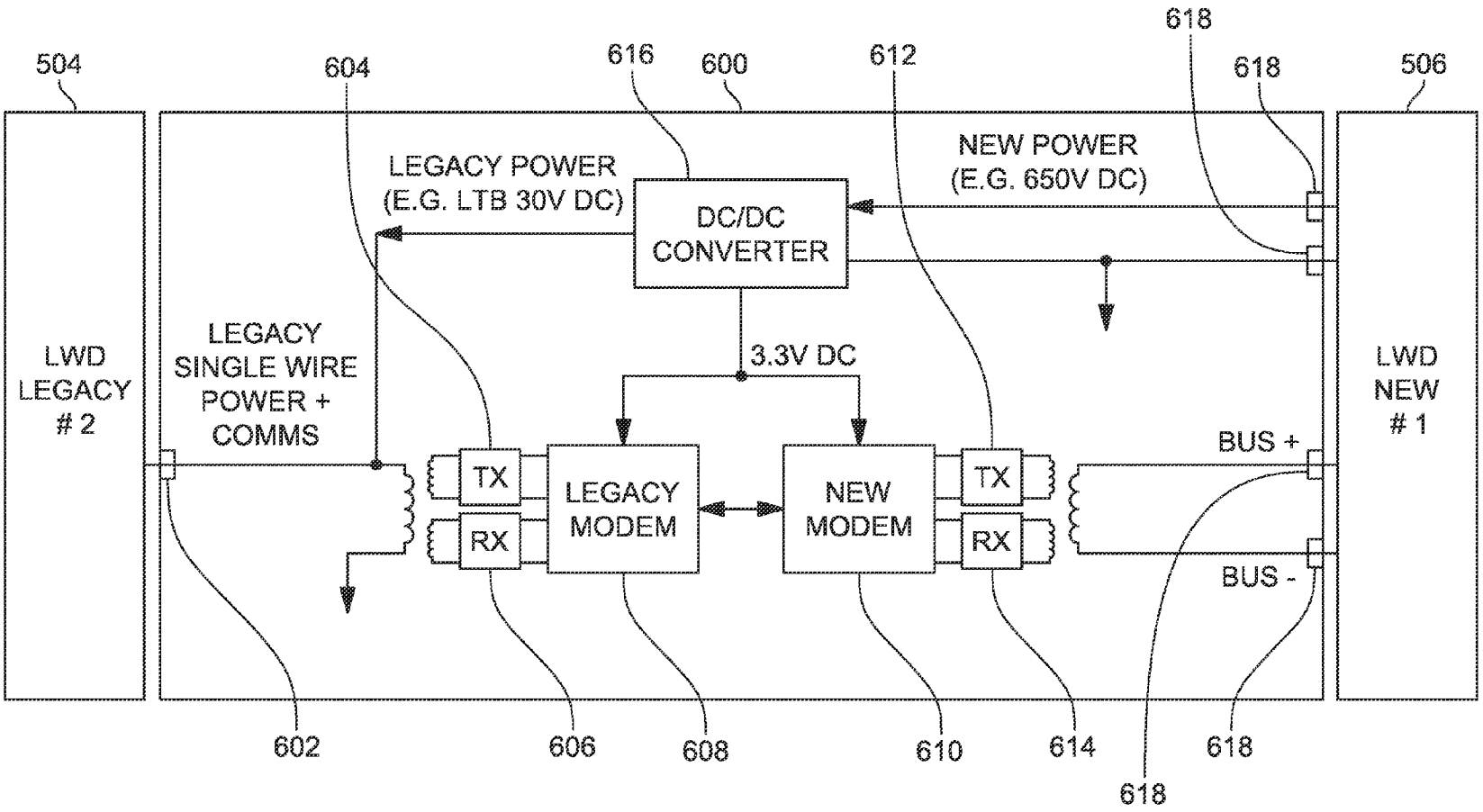
FIG. 6 illustrates an embodiment of a power and communications adapter that can be implemented in a system including a tool string, such as the tool string illustrated in FIG. 5.

An embodiment of a PCAS 600 (e.g., such as PCAS 204) is shown in FIG. 6. In an embodiment, the PCAS 600 can include an input/output terminal 602 configured to connect with a first tool (e.g., legacy LWD 504). In some embodiments, the input/output terminal 602 is a single-wire terminal configured to receive a power and communications signal via a single conductor. The PCAS 600 can include a first transmitter 604 and a first receiver 606 configured to transmit or receive communication signals according to a first communication protocol controlled by a first (e.g., legacy) modem 608. The PCAS 600 can also include a second transmitter 612 and a second receiver 614 configured to transmit or receive communication signals according to a second communication protocol controlled by a second (e.g., new) modem 610 that is in communication with the first modem 608. The first modem 608 can adapt the communication method of signals received from the second modem 610, and/or vice versa, to enable one-direction or bi-directional conversion of communication method between the first and second tools. In some embodiments, the modems 608 and 610 are implemented by a FPGA, DSP, microcontroller, ASIC, or the like. The PCAS 600 also has a power converter 616 (e.g., DC-to-DC converter) that steps up or down the voltage from the first tool to the second tool, and/or vice versa. The power converter 616 can also step down input power (e.g., voltage from the first or second tool) to a low voltage signal usable by the modems 608 and 610. In some embodiments, the PCAS 600 has a second terminal 618 with several input/output ports for power and communications. For example, the second terminal 618 can include at least two communication ports for a tool bus with bi-phase modulation and at least two ports for power.

In some embodiments, the PCAS can operate as the bus master for the first communication protocol and also as the bus slave for the second communication protocol. For example, the adapter's legacy modem (e.g., modem 608), as legacy bus master, can collect data from legacy tools (e.g., LWDs 502 and 504), and the legacy modem (e.g., modem 608) can send the data to the new system modem (e.g., modem 610). As the new bus slave, modem 610 can encapsulates the data into a packet following the new communication protocol and can send the encapsulated data to the new bus master (e.g. new system MWD 508). The PCAS's modems (e.g., modems 608 and 610) can also operate in reverse, e.g., where modem 608 is the legacy bus slave and modem 610 is the new system bus master.

Figure 7:
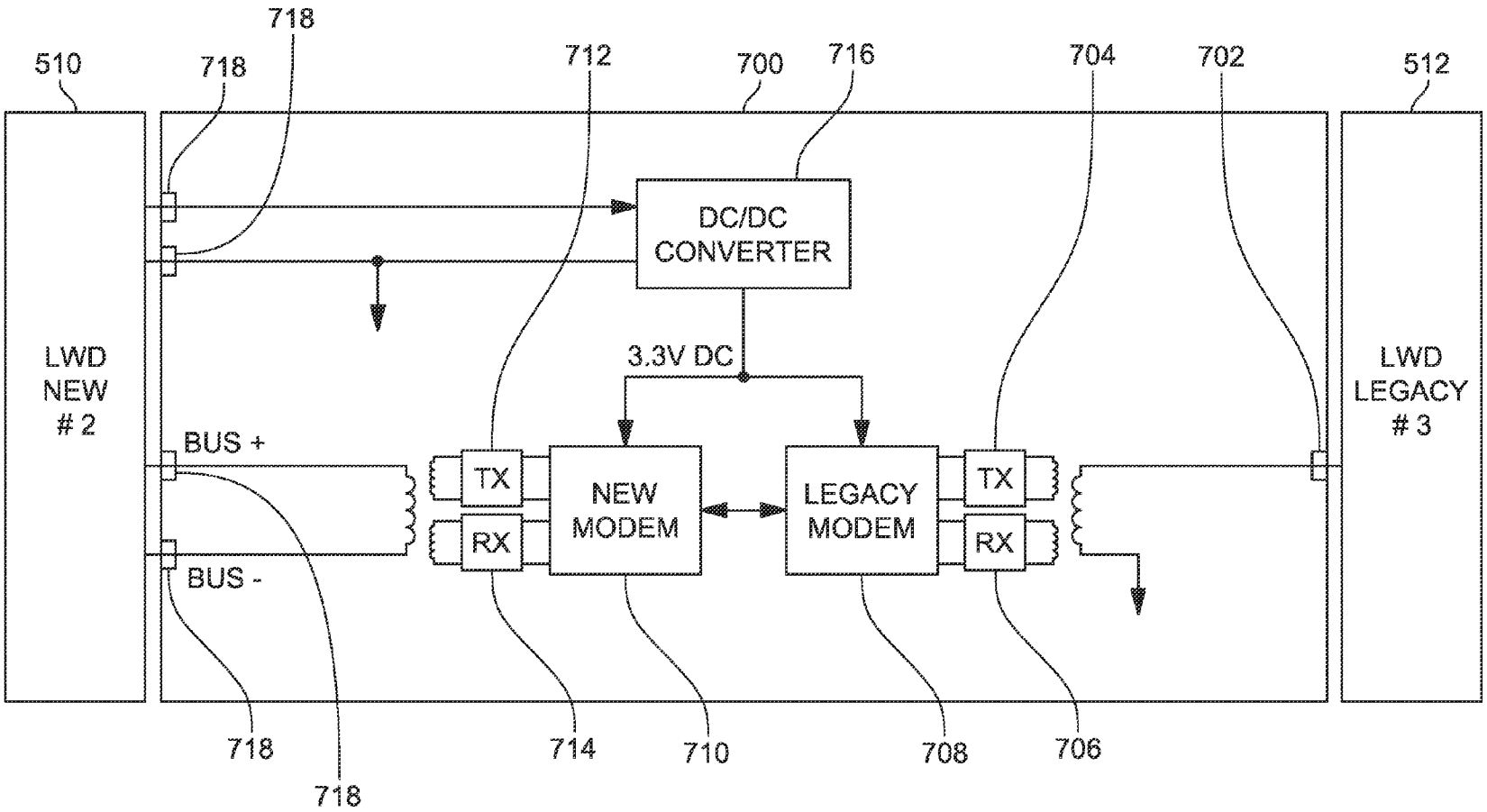
FIG. 7 illustrates an embodiment of a communications adapter module that can be implemented in a system including a tool string, such as the tool string illustrated in FIG. 5.

An embodiment of a CAM 700 (e.g., such as CAM 208) is shown in FIG. 7. In an embodiment, the CAM 700 can include an input/output terminal 702 configured to connect with a first tool (e.g., legacy LWD 512). In some embodiments, the input/output terminal 702 is a single-wire terminal configured to receive a power and communications signal via a single conductor. The CAM 700 can include a first transmitter 704 and a first receiver 706 configured to transmit or receive communication signals according to a first communication protocol controlled by a first (e.g., legacy) modem 708. The CAM 700 can also include a second transmitter 712 and a second receiver 714 configured to transmit or receive communication signals according to a second communication protocol controlled by a second (e.g., new) modem 710 that is in communication with the first modem 708. The first modem 708 can adapt the communication method of signals received from the second modem 710, and/or vice versa, to enable one-direction or bi-directional conversion of communication method between the first and second tools. In some embodiments, the modems 708 and 710 are implemented by a FPGA, DSP, microcontroller, ASIC, or the like. The CAM 700 also has a power blocker, or in some embodiments, a converter 716 (e.g., DC-to-DC converter) that steps down input power (e.g., voltage from the first or second tool) to a low voltage signal usable by the modems 708 and 710. In some embodiments, the PCAS 700 has a second terminal 718 with several input/output ports for power and communications. For example, the second terminal 718 can include at least two communication ports for a tool bus with bi-phase modulation.

Figure 8:
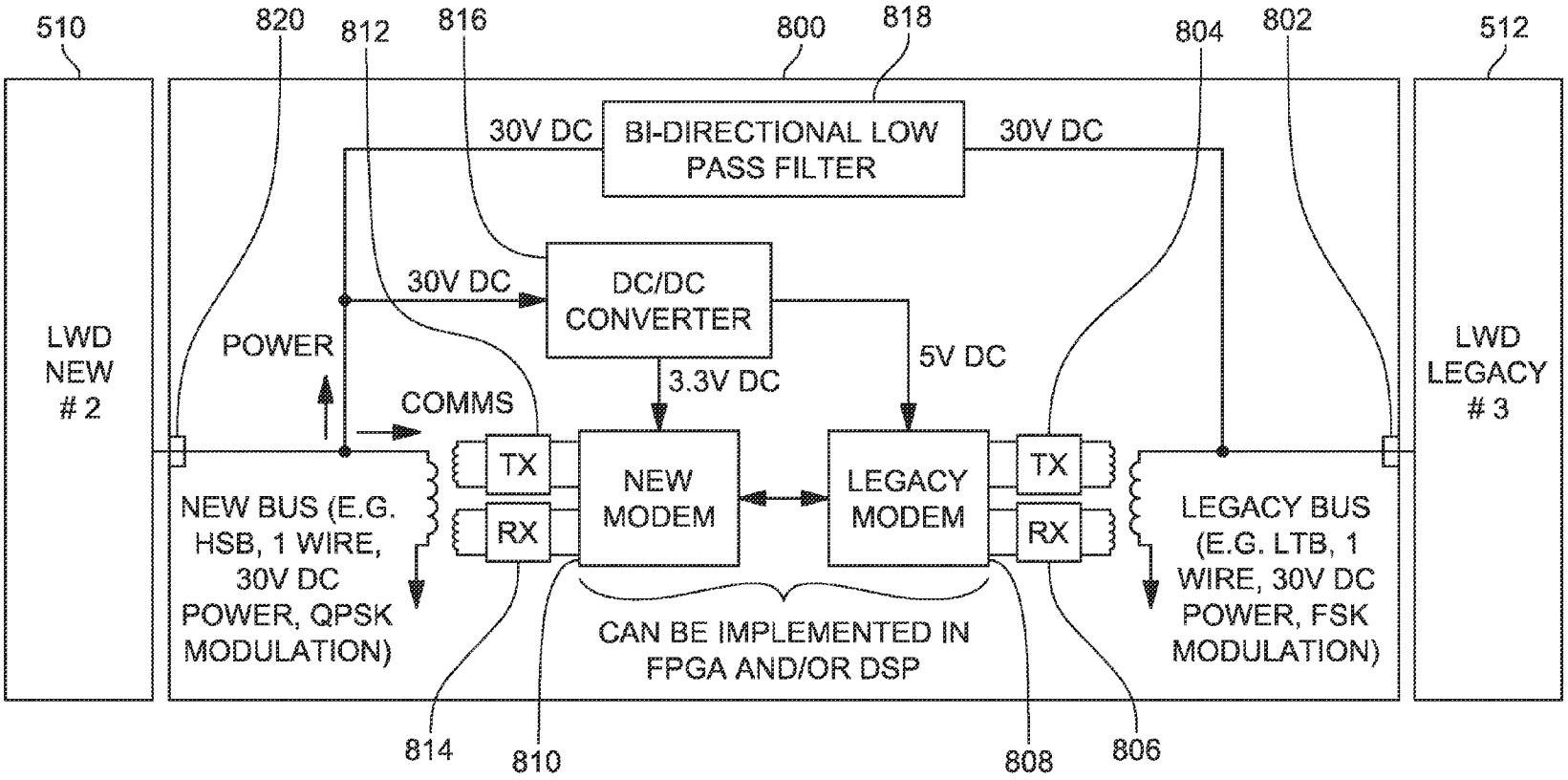
FIG. 8 illustrates an embodiment of a power and communications adapter that can be implemented in a system including a tool string, such as the tool string illustrated in FIG. 5.

In some embodiments, the first tool (e.g., legacy LWD 512) and the second tool (e.g., new LWD 510) are both configured to send power and communication signals via a single conductor. For example, the first BHA and the second BHA can both have one-wire power and communication, e.g., both at 30V DC, but each may implement a different signal format. For example, the first BHA can have a LTB tool bus with 4.8 kbps Frequency-Shift Keying (FSK) modulation communication signals, and the second BHA can have a high speed bus (HSB) tool bus with 150 kbps Quadrature Phase Shift Keying (QPSK) modulation communication signals. In such a tool string configuration, where the first and second BHAs both use the same power protocol (e.g., one-wire 30V DC), the BHAs can be coupled by CAMs without a PCAS (e.g., PCAS 204 can be replaced with another CAM). An embodiment of a CAM 800 (e.g., such as CAM 208) that can be used implement this type of tool string setup is shown in FIG. 8. In an embodiment, the CAM 800 can include an input/output terminal 802 configured to connect with a first tool (e.g., legacy LWD 512). In some embodiments, the input/output terminal 802 is a single-wire terminal configured to receive a power and communications signal via a single conductor. The CAM 800 can include a first transmitter 804 and a first receiver 806 configured to transmit or receive communication signals according to a first communication protocol controlled by a first (e.g., legacy) modem 808. The CAM 800 can also include a second transmitter 812 and a second receiver 814 configured to transmit or receive communication signals according to a second communication protocol controlled by a second (e.g., new) modem 810 that is in communication with the first modem 808. The first modem 808 can adapt the communication method of signals received from the second modem 810, and/or vice versa, to enable one-direction or bi-directional conversion of communication method between the first and second tools. In some embodiments, the modems 808 and 810 are implemented by a FPGA, DSP, microcontroller, ASIC, or the like. The CAM 800 also has a power converter 816 (e.g., DC-to-DC converter) that steps down input power (e.g., voltage from the first or second tool) to a low voltage signal usable by the modems 808 and 810. In some embodiments, the power converter 816 supplies each of the modems 808 and 810 with different voltages. The CAM can also include a bi-directional filter 818 (e.g., low pass filter) in between the first input/output terminal 802 and a second input/output terminal 820 that is configured to connect the second tool (e.g., new LWD 510). The bi-directional filter 818 passes through the power component of the signal from the first or second tool, while the communication component of the signal is isolated and converted by the other CAM circuitry.

The various PCAS and CAM architectures described herein can be used with LTB, HSB, EFTB, or other industry known protocols, such as Ethernet, TCP/IP, CAN, etc. In some implementations, the protocol or modulation conversion done by one or more DSPs and/or FPGAs. Power conversion/control can include stepping up or stepping down power, blocking, terminating, or passing through power (e.g., in CAM configuration), AC-to-DC, DC-to-AC, AC-to-AC, DC-to-DC conversions, and so forth. Additionally, the PCAS (e.g., PCAS 204) and/or CAM (e.g., CAM 208) can be powered by one of the BHAs or tools connected therewith, or by a dedicated battery or generator.

Figure 9:
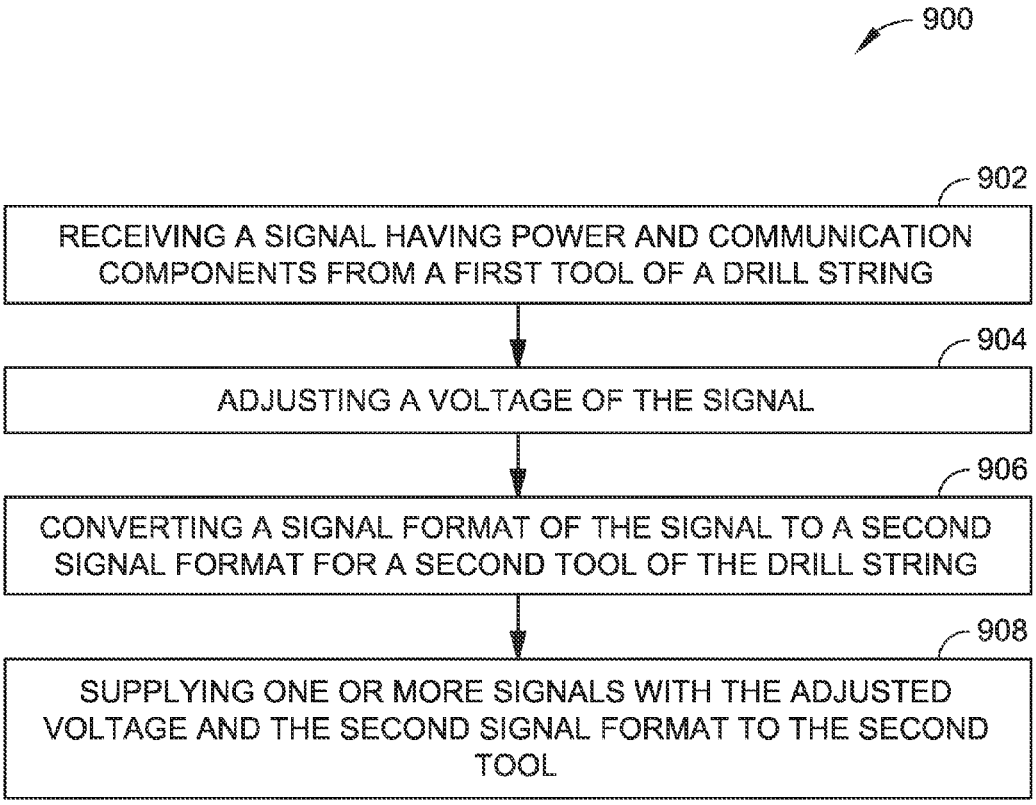
FIG. 9 illustrates an example process for adapting power and communication connections between electronic devices in a drill string.

FIG. 9 is a flow diagram illustrating a process 900 of adapting power and communication connections between electronic devices (e.g., BHAs or tools) in a drill string. A signal having power and communication components can be received from a first tool or BHA in a drill string (block 902). The voltage of the signal can be adjusted (block 904). For example, the voltage can be stepped up or stepped down using a power converter (e.g., power converter 406). The signal format of the signal can be converted to a second signal format for a second tool (e.g., another tool or BHA that is coupled to the first tool or BHA) in the drill string (block 906). For example, the communication method of the signal from the first tool or BHA can be converted to another communication method using a communications adapter (e.g., communications adapter 408). One or more signals having the adjusted voltage and/or the second (different) signal format are then provided to the second tool or BHA (block 908). In some embodiments, the power and communication components of the signal received from the first tool are separated into at least one power signal and at least one communications signal for respective ports of the second tool. For example, the signal received from the first tool or BHA can be transmitted over a single conductor and can be separated into separate communication and power signals that are then transmitted via separate conductors to respective ports of the second tool or BHA.

Although only a few example embodiments have been described in detail above, those skilled in the art will readily appreciate that many modifications are possible in the example embodiments without materially departing from the current disclosure. Features shown in individual embodiments referred to above may be used together in combinations other than those which have been shown and described specifically. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. An adapter for power and communication connections between electronic devices in a drill string, comprising:

a first terminal configured to couple with an output terminal of a first tool;

a second terminal configured to couple with an input terminal of a second tool;

a power converter that adjusts a voltage received at the first terminal and supplies the adjusted voltage to the second terminal; and a communications adapter that converts a signal format of a communications signal received at the first terminal to a second signal format for the second terminal;

wherein the power converter converts an AC input signal into a DC output signal, converts a DC input signal into an AC output signal, steps an input voltage in the range of 10V to 100V up to an output voltage in the range of 200V to 1000V, or steps an input voltage in the range of 200V to 1000V down to an output voltage in the range of 10V to 100V.

2. The adapter as recited in claim 1, wherein the first terminal is embedded within or coupled to a first bottom hole assembly, and the second terminal is embedded within or coupled to a second bottom hole assembly.

3. The adapter as recited in claim 1, wherein the first terminal comprises a single-wire input terminal, and the second terminal comprises a multiple-wire output terminal.

4. The adapter as recited in claim 3, wherein the communications adapter converts a combined communications and power signal received by the single-wire input terminal into at least one power signal and at least one communications signal for respective ports of the multiple-wire output terminal.

5. The adapter as recited in claim 1, wherein the first terminal is structured to receive a different connector type from the second terminal.

6. The adapter as recited in claim 1, wherein the first terminal implements a different communication protocol than the second terminal.

7. The adapter as recited in claim 6, wherein the first terminal implements a passband communication protocol, and the second terminal implements a baseband communication protocol.

8. The adapter as recited in claim 1, wherein the first terminal and the second terminal both implement a passband communication protocol or both implement a baseband communication protocol.

9. A system for power and communication connections between electronic devices in a drill string, comprising:

a plurality of tools physically connected with one another along a drill string; and an adapter comprising: a first terminal coupled with an output terminal of a first tool of the plurality of tools; a second terminal coupled with an input terminal of a second tool of the plurality of tools; a power converter that adjusts a voltage received at the first terminal and supplies the adjusted voltage to the second terminal; and a communications adapter that converts a signal format of a communications signal received at the first terminal to a second signal format for the second terminal;

wherein the power converter converts an AC input signal into a DC input signal, converts a DC input signal into an AC input signal, steps an input voltage in the range of 10V to 100V up to an output voltage in the range of 200V to 1000V, or steps an input voltage in the range of 200V to 1000V down to an output voltage in the range of 10V to 100V.

10. The system as recited in claim 9, wherein the first terminal is embedded within or coupled to a first bottom hole assembly, and the second terminal is embedded within or coupled to a second bottom hole assembly, the first bottom hole assembly including the first tool, and the second bottom hole assembly including the second tool.

11. The system as recited in claim 9, wherein the first terminal comprises a single-wire input terminal, and the second terminal comprises a multiple-wire output terminal.

12. The system as recited in claim 11, wherein the communications adapter converts a combined communications and power signal received by the single-wire input terminal into at least one power signal and at least one communications signal for respective ports of the multiple-wire output terminal.

13. The system as recited in claim 9, wherein the first terminal is structured to receive a different connector type from the second terminal.

14. The system as recited in claim 9, wherein the first tool communicates with a different communication protocol than the second tool.

15. The system as recited in claim 14, wherein the first tool utilizes a passband communication protocol, and the second tool utilizes a baseband communication protocol.

16. The system as recited in claim 14, wherein the adapter is operable as a bus master for the first communication protocol and as a bus slave for the second communication protocol.

17. The system as recited in claim 9, wherein the first tool and the second tool both utilize a passband communication protocol or both utilize a baseband communication protocol.

18. The system as recited in claim 9, further comprising:

a power blocker that substantially stops a power component of a signal transmitted by the first tool or the second tool from being received by a third tool of the plurality of tools; and a signal extractor that isolates a communication component of the signal and transmits the communication component of the signal to the third tool.

19. A method of adapting power and communication connections between electronic devices in a drill string, comprising:

receiving a signal having power and communication components from a first tool of a drill string;

adjusting a voltage of a power component of the signal, wherein said adjusting comprises converting an AC input signal into a DC input signal, converting a DC input signal into an AC input signal, stepping an input voltage in the range of 10V to 100V up to an output voltage in the range of 200V to 1000V, or stepping an input voltage in the range of 200V to 1000V down to an output voltage in the range of 10V to 100V;

converting a signal format of a communication component of the signal to a second signal format for a second tool of the drill string; and supplying one or more signals with the adjusted power component and the second signal format to the second tool.

20. The method as recited in claim 19, wherein the power and communication components of the signal received from the first tool are separated into at least one power signal and at least one communications signal for respective ports of the second tool.

21. The method as recited in claim 19, wherein the signal format is converted based upon a first communication protocol of the first tool being different from a second communication protocol of the second tool.

22. A system for power and communication connections between electronic devices in a drill string, comprising:

a plurality of tools physically connected with one another along a drill string;

an adapter comprising: a first terminal coupled with an output terminal of a first tool of the plurality of tools; a second terminal coupled with an input terminal of a second tool of the plurality of tools; a power converter that adjusts a voltage received at the first terminal and supplies the adjusted voltage to the second terminal; and a communications adapter that converts a signal format of a communications signal received at the first terminal to a second signal format for the second terminal;

a power blocker that substantially stops a power component of a signal transmitted by the first tool or the second tool from being received by a third tool of the plurality of tools; and a signal extractor that isolates a communication component of the signal and transmits the communication component of the signal to the third tool.

* * * * *